US005391246A

United States Patent [19]

Stephens

[11] Patent Number: 5,391,246

[45] Date of Patent: Feb. 21, 1995

[54] FIRE PREVENTION IN THE APPLICATION OF ROOFING

[76] Inventor: William G. Stephens, 2844 S. Lenox, Milwaukee, Wis. 53207

[21] Appl. No.: 93,447

[22] Filed: Jul. 19, 1993

Related U.S. Application Data

[63] Continuation of Ser. No. 804,358, Dec. 9, 1991, abandoned.

[51] Int. Cl.[6] ..... F04B 2/00

[52] U.S. Cl. ..... 156/71; 52/746; 156/82; 427/372.2; 427/393.3; 427/397

[58] Field of Search ..... 156/71, 82; 52/746; 427/393.3, 397, 372.2

[56] References Cited

U.S. PATENT DOCUMENTS 2,178,625 1/1938 Clayton et al. ..... 427/393.3 X 3,840,388 10/1974 Perlus et al. ..... 156/281 X 4,944,818 7/1990 Dybsky et al. ..... 156/82 X

*Primary Examiner*—Bernard Pianalto

*Attorney, Agent, or Firm*—Nilles & Nilles

[57] ABSTRACT

A method for the prevention of fire caused by the application to a flammable substratum of a modified bitumen roofing membrane involving concurrent flame heating of the roofing material and substratum during application. The method comprises applying an aqueous solution of fire retardant chemicals to all flammable surfaces to be roofed and adjacent thereto prior to the flame heating of the modified bitumen membrane and the substratum. The fire retardant solution may be applied by a variety of application techniques on the job site or to the roof components prior to construction assembly. Preferred fire retardant formulations and rates of application are disclosed.

4 Claims, No Drawings

FIRE PREVENTION IN THE APPLICATION OF ROOFING

This application is a continuation of application Ser. No. 07/804,358, filed Dec. 9, 1991, now abandoned.

BACKGROUND OF THE INVENTION

1. FIELD OF THE INVENTION

This invention relates to a method of fire prevention during and after the application of a roof or roof repair requiring flame heating. More especially this invention relates to a method of fire prevention during and after the application of modified bitumen roofing membranes, and the repair of modified bitumen roofs.

Modified bitumen is a general class of asphaltic roofing membrane that has been manufactured and widely used in Europe and the United States for twenty-five years. Modified bitumen membrane consists of a layer of bitumen waterproofing material, modified with plastomers to add strength, and having an embedded reinforcing fabric. The modified bitumen membrane is heat welded by an open flame torch to a contact point which is concurrently flame heated. The contact point, or substratum, is usually a flammable material such as wood, insulation, wood fiber, plywood, tar paper, or the like. The perimeter of the roof is usually surrounded by parapet walls which are considered a continuation of the roof itself. The contact point for parapet walls can include the previously mentioned flammable materials and they also include brick, cinder block and sheet metal flashing. Although these latter materials are not themselves flammable, they tend to collect flammable materials such as leaves, paper, dust, etc.

The open flame torches used for application of modified bitumen roofing membranes, usually fueled with propane, vary from 50,000 BTU hand-held torches to multiple torch machines capable of two million BTUs. The hand-held torch is waved in a side-to-side motion to heat the underside of the modified bitumen membrane for adhesion to the contact point. The multiple head torch machine is pulled backward from an unrolling roll of bitumen membrane to heat the modified bitumen and contact point. These procedures may vary somewhat depending upon the ambient temperature, applicator discretion, different melting points of modified bitumens and different torches.

While heating the modified bitumen the open flame deflects and superheats the contact point and surrounding area. This often causes flammable materials to smolder, glow and catch fire. If the fire is detected by the applicator, he must take the extra time to extinguish the flame. When the smoldering or glow of a possible fire is undetected, it is covered by the roofing membrane and becomes a great hazard. The smoldering glow in wood walls and insulation can last for hours before bursting into flame. The resulting fire is hard to reach on the roof, usually spreads fast and may be very dangerous.

2. The Prior Art

Although modified bitumen membrane has been in use for twenty-five years, fires have been a constant hindrance and safety problem. In spite of this to applicant's knowledge, no method of preventing such fires has been proposed.

SUMMARY OF THE INVENTION

The method of the present invention overcomes the risks and safety hazards of fires and makes roofing and roofing repair practices safer, easier and less costly. Broadly stated, the invention is directed to a method for the prevention of fire in the application to a substratum of a modified bitumen roofing membrane involving concurrent flame heating of the roofing material and substratum during application, the method comprising the application to all flammable surfaces to be roofed and adjacent thereto, an aqueous solution of fire retardant chemicals prior to flame heating thereof.

DETAILED DESCRIPTION OF THE PREFERRED EMBODIMENT

The waterproofing qualities of asphaltic bitumenous materials have been recognized and used in the application of roofs for many, many years, by spreading heated molten tar-like material to the surface to be waterproofed, and then embedding gravel or other granular material over the surface. The development of modified bitumen membranes, available in rolls, greatly simplified the application of bitumen roofing materials. Modified bitumen membranes are composed of an asphaltic waterproofing layer modified with a thermoplastic synthetic resinous material and reinforced with an embedded fabric layer. Atactic polypropylene and styrene-butadiene-styrene rubber are typical modifiers. Polyester fabric, usually spunbond continuous filament nonwoven polyester fabric, is used as reinforcement. The overall membrane usually ranges from about 150 to 180 mils in thickness. They may have ceramic granules embedded in the outer surface. They are commonly supplied in rolls about 32 to 34 feet in length and about 39 to 40 inches in width. Modified bitumen roofing membranes are commercially available from a number of sources including Firestone Building Products, Carmel, Indiana; U.S. Intec, Inc., Port Arthur, Tex. and Bitec Bitumen Technology, Morrilton, Ariz. In some instances the modified bitumen membrane may be supported by rigid panels which are applied to the roof substratum.

A wide variety of water soluble fire retardant materials are known and may be used in the practice of this invention. These include compounds of boron, such as boric acid and sodium borate; ammonium compounds such as mono- and diammonium phosphate and magnesium ammonium phosphate, used singly or in admixture. Preferably also a small amount of a surfactant or wetting agent, such as a liquid dishwashing detergent or the like is included in the solution.

One exemplary fire retardant solution which has been found to be useful in the practice of this invention is composed of about 5 to 6 percent by weight of sodium borate, about 2 to 3 percent of boric acid, about 3.5 to 4.5 percent of diammonium phosphate and about 0.06 to 0.1 percent of a non-ionic surfactant, such as octylphentol ethoxylate, and about 86.5 to 89.5 percent water. A preferred fire retardant solution is composed of about 5.5 percent by weight of sodium borate, about 2.5 percent of boric acid, about 4 percent of diammonium phosphate, about 0.08 percent of the non-ionic surfactant and about 88 percent water.

The fire retardant solution is applied to the roof substratum and surrounding areas including parapet walls anywhere from immediately prior to application of the flame heating to days prior thereto. The solution may be applied by brushing with a brush or mop, by means of a roller or by spraying, or the like. A sufficient quantity of solution, usually about 3 to 8 ounces of solution per square foot, is applied to evenly and completely cover the surfaces being treated. While greater amounts of chemical solution may be applied, this adds to the costs without commensurate added protection. Where appropriate, the solution may be applied by immersion, such as to components of the area being roofed, such as plywood or particle board panels, parapet wall members, and the like, prior to construction assembly of the area to be roofed.

The fire retardant solution is preferably prepared by first heating the water to a temperature between about 140 to 200 degrees F. and dissolving the chemicals in it by stirring continuously as they are added. The solution is then cooled to lukewarm or ambient temperature before application.

Although the fire prevention method of the invention is intended primarily for use during the application of new roofing, it is equally applicable to use during repair of existing roofs.

The invention is illustrated by the following examples:

EXAMPLE 1

A one foot by one foot by one-half inch piece of wood fiberboard was sprayed with fire retardant solution according to the preferred exemplary formulation. The sprayer used was a trigger pump hand-held 24 ounce common household plastic spray bottle with the nozzle set on mist. Four ounces liquid of fire retardant solution was sprayed on the one square foot panel. The treated wood fiberboard was then laid next to a similar sized panel, cut from the same larger board, of untreated fiberboard. A hand-held propane torch with a pencil-point tip was used to introduce flame heat to both surfaces. Direct flame heat was applied for ten seconds. The untreated wood fiberboard started to glow immediately and smoldered for thirty minutes until extinguished by dousing in water. The treated fiberboard panel developed a glow but extinguished itself immediately upon removal of the torch flame.

EXAMPLE 2

The roof of a local junior high school developed a leak against the parapet wall where the wall met the roof. After the gravel was removed the roof area was prepared by spraying fire retardant solution, according to the exemplary preferred formulation, under the sheet metal flashing to prevent fire. Such a parapet wall is considered a volatile area because flammable materials under the flashing cannot be detected. When the open flame heat is applied to the roof surface the flame can deflect under the flashing where the flammable material may begin to glow and smolder and eventually catch fire, often hours after the operation is considered to be completed. The fire retardant solution was applied at the rate of six ounces liquid per square foot. A modified bitumen waterproofing membrane was used in making the repair. A 50,000 BTU torch was used in final preparation of the substratum and modified bitumen membrane. No smoldering or fire occurred.

EXAMPLE 3

On the same job site as Example 2, while waiting for the roofing to be completed, an old weathered piece of plywood was broken in half to make two pieces each about 0.75 inch wide by 6 inches long. One piece was sprayed with fire retardant solution, as in Example 2. The other piece was left in its natural state. The same 50,000 BTU open flame torch was used to introduce heat. Five seconds of equal simultaneous heat caused the natural state piece of plywood to burn to ash. The treated piece of plywood extinguished itself immediately.

EXAMPLE 4

A large industrial building was having a new roof laid over an existing roof which consisted of a Tectum deck with a built-up organic felt/coal tar pitch/gravel top layer. The roof was sloped with a three inch rise every twelve inches. At the top of the roof a wall supported a skylight dome. The wall between the roof and the skylight was constructed of wood and had been repaired several times since the installation of the roof. The repair material used was six inch wide cotton mesh set in plastic asphalt cement and fiberglass mesh set in plastic asphalt cement. The walls had been a fire hazard in the past, as evidenced by the fire experienced in previous applications involving torch applied materials. The same roofing service had suffered a fire under the same circumstances with the same details on an identical building at the same industrial site. That wood wall between the skylight and sloped roof caught fire and needed to be put out by fire extinguishers. The wood wall of the current roofing project was very dry. This, coupled with the cotton mesh and fiberglass mesh repairs, made this detail extremely flammable.

Prior to the application of the new roof, a demonstration was conducted by removing two pieces of the cotton mesh, each four inches long by two inches wide from the wall between the roof and skylight. One of these cotton mesh pieces was treated with the fire retardant accordingly to the exemplary formulation. The other was left in its natural state. A 100,000 BTU hand-held propane torch was used to introduce flame heat to both pieces of cotton mesh. While heating the piece of cotton mesh that was treated with the fire retardant composition, a glow developed which immediately extinguished itself when the flame was removed. The untreated piece of cotton mesh continued to burn after the flame was removed until it was extinguished by spraying with the fire retardant solution.

The new roof was simply layered over the existing roof by securing four foot by four foot perlite boards with a modified bitumen face through the existing roof to the Tectum deck with Tectum fasteners. The modified bitumen layer (Nord Poly 4B, manufactured by Nord Bitumi U.S. Inc., Springfield, N.J.) was adhered by heating with a 100,000 BTU propane fired single head open flame torch. A one inch by six inch dimension wood hailer was fastened to the roof where it meets the wall so the modified bitumen can be nailed to the top to prevent future traveling of the material. While heating the modified bitumen and substratum in the area of detail with the 100,000 BTU torch, the applicator waves the torch in a side-to-side motion to heat the modified bitumen for adhesion to the contact point. The open flame of the torch is deflected and superheats the contact point and surrounding area.

A field test was conducted on the hazardous wood wall between the roof and skylight covered with cotton mesh, fiberglass mesh and asphalt which extended vertically eight inches from the roof to the skylight. A sheet metal flashing hung two inches down from the skylight. The length of the field test area was eighty feet horizontal. The same fire retardant solution was applied by spraying at a rate of about three ounces per square foot. The fire retardant solution was sprayed under the sheet metal flashing at a sporadic rate until effective saturation was evident by constant visual flowage. Due to the volatility of the exposed wood, cotton mesh and fiberglass mesh, fire retardant was applied heavier at a rate of approximately four to six ounces per square foot in those areas.

After the fire retardant was applied, the applicator introduced heat with the torch. In some instances, the flame was left on the contact point longer than usual for test purposes. In all instances application of the fire retardant was proven to be effective for fire prevention. No fire or smoldering occurred in the test area.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A method of installing roofing material onto a rooftop of a building, wherein the rooftop comprises a substratum, parapet walls, flashing or other structural parts thereof constructed at least in part by untreated wood, plywood or other combustible material, the method comprising:

saturating the surfaces of said combustible material with a fire-retardant liquid by brushing, rolling or spraying from upon the rooftop at ambient temperature and pressure an aqueous solution of fire-retardant boron compounds buffered with boric acid onto said substratum and parapet walls, underneath said flashing, and onto the other combustible surfaces of the roof;

unrolling a roll of a modified bitumen roofing membrane which comprises a layer of bitumen waterproofing material embedded with a reinforcing fabric; and, heat welding the membrane to the roof substratum by concurrently flame heating the underside of the membrane and the surface of the substratum.

2. The method according to claim 1 further comprising premixing the fire-retardant solution, said premixing comprising:

heating a volume of water to about 140° F. to 200° F.;

adding and dissolving into the heated water:

about 5% to 6% by weight of sodium borate;

about 2% to 3% by weight of boric acid;

about 3.5% to 4.5% by weight of diammonium phosphate; and about 0.06% to 0.10% of a non-ionic surfactant;

and, cooling the solution to ambient temperature.

3. The method according to claim 2, wherein the compounds dissolved into the water comprise:

about 5.5% sodium borate;

about 2.5% boric acid;

about 4% diammonium phosphate; and about 0.08% non-ionic surfactant.

4. The method according to claim 2, further comprising applying evenly and completely about 3 to 8 ounces of solution per square foot of the surface being treated.

* * * * *